United States Patent [19]

Felix et al.

[11] 4,448,473

[45] May 15, 1984

[54] LATCHING SLOTTED BEAM TERMINAL

[75] Inventors: Ronald G. Felix, Harrisburg; Douglas R. Hoffman, Hummelstown, both of Pa.

[73] Assignee: AMP Incorporated, Harrisburg, Pa.

[21] Appl. No.: 364,169

[22] Filed: Mar. 31, 1982

[51] Int. Cl.[3] ..... H01R 11/20

[52] U.S. Cl. ..... 339/99 R; 339/97 P

[58] Field of Search ..... 339/17 F, 97 R, 97 P, 339/98, 99 R

[56] References Cited

U.S. PATENT DOCUMENTS

| | | | |
|---|---|---|---|
| 3,189,863 | 6/1965 | Leach | 339/99 |
| 3,805,214 | 4/1974 | Demler, Sr. et al. | 339/97 R |
| 3,820,055 | 6/1974 | Huffnagle et al. | 339/17 F |
| 4,231,632 | 11/1980 | Badoz et al. | 339/97 R |
| 4,232,927 | 11/1980 | Stull | 339/99 R |
| 4,262,984 | 4/1981 | Takahashi | 339/97 R |
| 4,346,955 | 8/1982 | Chesnais et al. | 339/97 R |
| 4,364,622 | 12/1982 | Huntley | 339/98 |
| 4,381,132 | 3/1983 | Tournier | 339/99 R |

*Primary Examiner*—John McQuade
*Assistant Examiner*—Paula Austin
*Attorney, Agent, or Firm*—Russell J. Egan

[57] ABSTRACT

An improved latching slotted beam terminal is disclosed having two slotted plates connected by a bight and folded into overlying position. One plate has relatively short, stiff arms defining a narrow conductor engaging slot. The other plate has relatively long, flexible arms defining a slot wider than the conductor and outwardly directed shoulders on the free ends of the tines. The wire gripping will be by the first plate and latching of an associated cover member by the second plate.

6 Claims, 4 Drawing Figures

LATCHING SLOTTED BEAM TERMINAL

The present invention relates to a slotted beam terminal and in particular, to one having an improved latching capability.

The prior art is best represented by U.S. Pat. No. 3,820,055 which discloses an electrical terminal and connector of the type sold by the present assignee, AMP Incorporated, under the trademark AMPLATCH. This terminal and connector overcame many of the difficulties of the prior art, as for example, represented by U.S. Pat. No. 3,189,863. In this earlier patent a connector system was described in which the terminals provided a slotted beam interconnect with the associated conductors. However, there was no way to hold the cover tightly against the terminal so that it was quite impossible for proper connection to be maintained at the center of a long connector where conductors, in fact, could work loose from the respective terminals. The subsequent development of Huffnagle and Wasserlein provided a latching configuration on the end of the terminal which would engage the cover to securely hold it against the main connector housing across the entire width thereof. Thus, it was possible to make a connector for terminating cables on the order of, for example, 50 conductors, and still have a good interconnection all away across the connector. This latching configuration, while it did provide good latching hold down of the cover on the housing, sometimes induced additional problems in that the flexure of the terminal caused when the cover was engaged, overcut into the conductor so that there was the possibility of some looseness occurring between the conductor and the terminal when the latter was in the fully inserted and latched condition in the cover.

The present invention obviates the difficulties of the known prior art by providing a slotted beam terminal which is comprised of a pair of plate members connected by a bight and folded to lie on top of one another. The first plate member has a pair of short rigid arms defining a narrow slot and adapted to make an insulation piercing engagement with a conductor. The second plate has a pair of long flexible arms defining a slot having a width greater than that of the conductor and with outwardly directed latching shoulders on the free ends of the arms. Thus, the first plate makes the insulation piercing contact with the conductor and there is no need for the arms thereof to flex, and the arms of the second plate do not engage the conductor and yet are sufficiently resilient to make the necessary flexure so that the shoulders on the ends thereof can engage with respective shoulders of the cover to hold it and the housing tightly together. The opposite end of the terminal is formed with a mating profile of either a pin or receptacle configuration.

The present invention will now be described by way of illustrative example with reference to the accompanying drawings in which.

Figure 1:
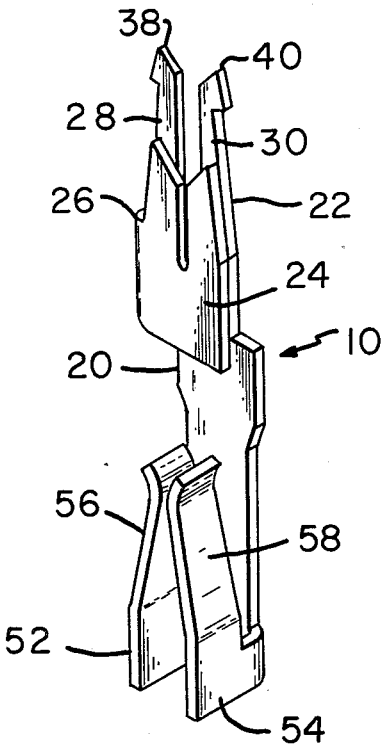
FIG. 1 is a perspective view of a terminal according to the present invention.
Figure 2:
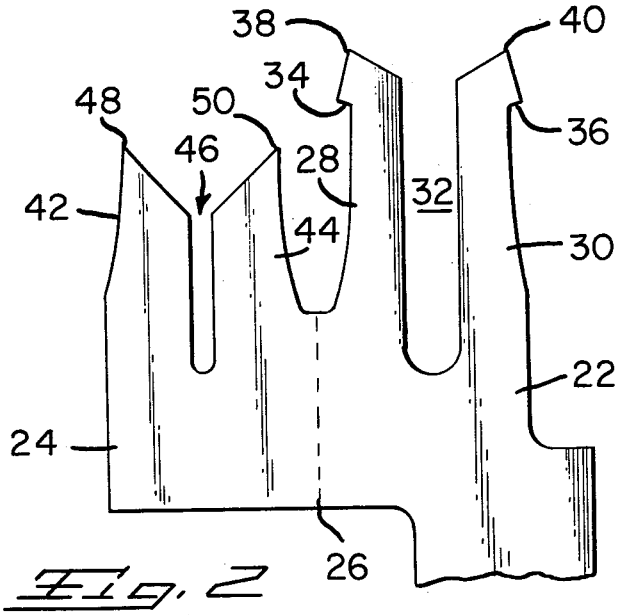
FIG. 2 is an open plan view of the slotted plate portions of the terminal according to the present invention.
Figure 3:
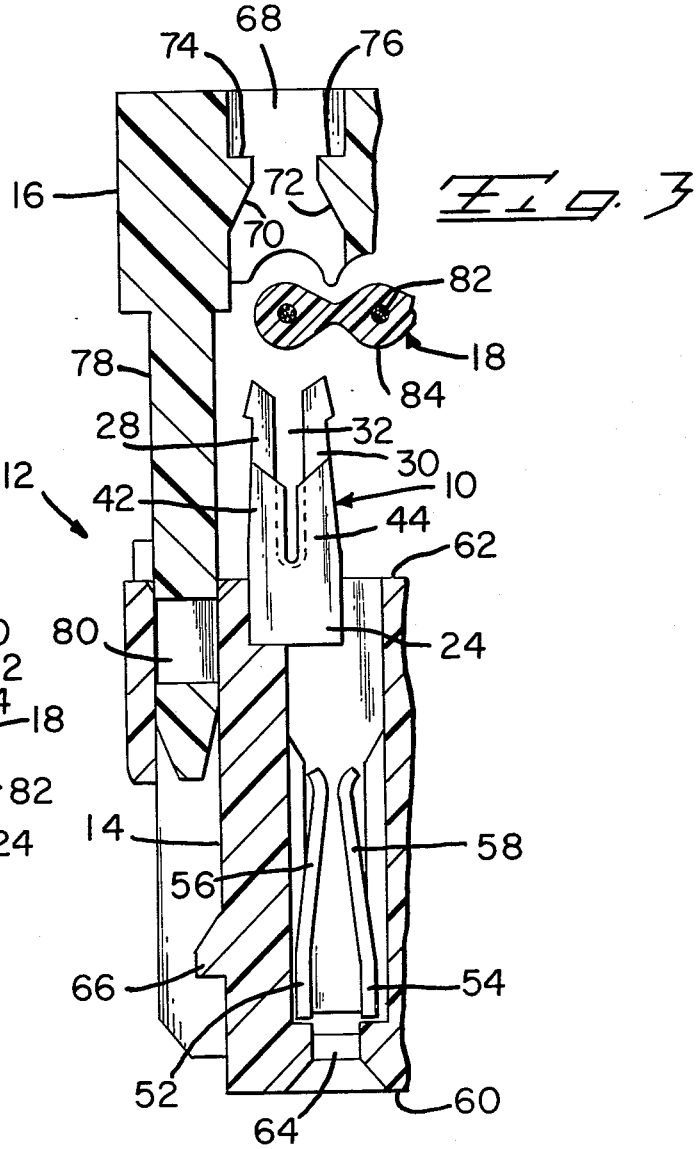
FIG. 3 is a section through an end portion of a connector incorporating the terminal of the present invention, the connector being shown in an open condition.
Figure 4:
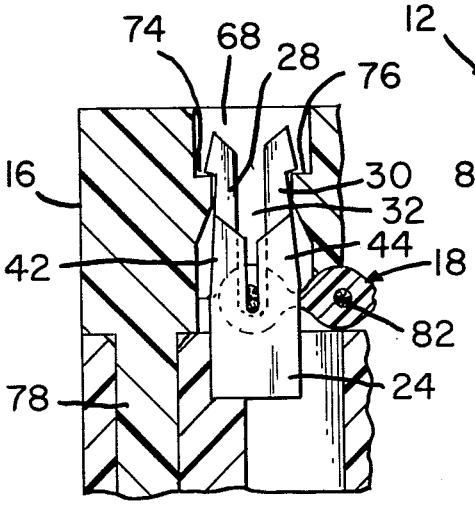
FIG. 4 is a fragmentary end view of the connector of FIG. 3 in a closed and terminated condition.

The terminal 10 of the present invention is intended to be used in a connector 12 having a housing 14 and a cover 16 for terminating a multi-conductor flat flexible cable 18. The connector 10 has a body 20 with a first slotted plate portion 22 extending from one end thereof. A second slotted plate portion 24 is connected to the first slotted plate portion 22 by means of a bight 26.

The first slotted plate portion has a pair of long, flexible latching arms 28, 30 defining a wide slot 32 therebetween. The slot 32 is generally wider than the conductor to be received therein. Each arm has an outwardly directed shoulder 34, 36 on the free end thereof. The ends of each arm 38, 40 are pointed for purposes of insulation piercing. The second slotted plate portion 24 has a pair of rather short stiff arms 42, 44 defining a narrow conductor engaging slot 46 therebetween. The slot 46 is generally not as wide as the conductor received therein. The free end of each arm 42, 44 has an insulation piercing point 48, 50 respectively.

The opposite end of the terminal may be profiled as desired for the mating with another terminal. In the present instance, the terminal has been shown with a pair of upstanding sidewalls 52, 54 defining a pair of inwardly directed cantilever arms 56, 58 forming a receptacle. The mating end of the terminal could be formed in any mating profile. The terminal also can be provided with latching means (not shown) if this is deemed necessary.

The connector 12 illustrated is of a somewhat conventional configuration with the housing 14 having a mating face 60 and an oppositely directed cable receiving face 62 with a plurality of terminal passages 64 extending therebetween. Each terminal 10 is mounted in a respective passage 64 with the slotted plate portions 22, 24 extending above the cable receiving face 62. The housing 14 also includes a cover latching lug 66. The cover 16 has a plurality of apertures 68 each aligned with a respective passage 64. Each passage 68 has a pair of spaced inwardly directed lugs 70, 72 forming a pair of upwardly directed shoulders 74, 76. The cover is also provided with a latching leg 78 having an aperture 80 positioned to receive the lug 66 therein.

The terminating operation of the present invention is quite similar to those of the prior art in that the cover 16 is placed on the loaded connector housing 14 and the cable 18 is positioned therebetween. The cover 16 is then driven against the cable 18 to drive the respective conductors 82 into the insulation piercing portions of the respective terminals 10. In the present instance, both the first and second plates 22, 24 would pierce the insulation 84 of the cable 18 but only the arms 42, 44 of the second plate 24 would actually make contact with the conductor 82. The arms 28, 30 of the first plate would pierce the insulation 84 and then would flex inwardly passing the lugs 70, 72 and then relax to their natural state with the shoulders 34, 36 engaging the shoulders 74, 76. At the same time, the latching arm 78 of the cover would engage the latching lug 66 of the housing 14.

It will be appreciated from the foregoing that the greatest flexure of arms will take place in the first plate and there will be substantially no movement of the arms of the second plate. Thus, there will be no unnecessary displacement of the metal of the conductor 82 and a tight mechanical and electrical interconnection between the terminal and conductor will be formed.

We claim:

1. A stamped and formed electrical terminal for forming an electrical connection with an insulated conductor and having a conductor engaging portion and a mating portion extending from opposite ends of a main body, said conductor engaging portion having a pair of closely spaced parallel substantially planar plate sections connected by a bight extending along corresponding first sides of the plate sections, each plate section having a pair of spaced apart arms extending from second corresponding sides of said plate sections, said main body being connected to a third side of at least one of said plate sections characterized by the arms of one said plate section being of a first set of dimensions of width and length to define therebetween a slot narrower than the conductor with the arms being stiff and unyielding to deflection in the plane of said one plate section and the arms of the second plate section being of width and length dimensions to be of greater length than said arms of said one plate section and defining therebetween a slot wider than the conductor to be resilient and more capable of deflection in the plane of said second plate than the arms of said one plate section, and said second arms having outwardly directed latching shoulders adjacent the free ends thereof.

2. An electrical connecting device for forming electrical connections with conductors of multi-conductor flat cable of the type having a plurality of conductors in parallel side-by-side relationship and contained in a web of insulating material, said connecting device having a base member of insulating material with a plurality of terminal passages extending therethrough from a mating face to a cable receiving face, a cover member adopted to be assembled with a base member against the cable receiving face side thereof, the cover member having a plurality of openings therein each aligned with a respective terminal opening of the base member, and a plurality of electrical terminals each mounted in a respective passage of said base member with a mating portion directed toward said mating face and an insulation piercing conductor engaging portion extending from the cable receiving face, characterized by:

said insulation piercing conductor engaging portion being formed by a pair of plates connected by a bight so as to overlie one another, the first of said plates having a first pair of spaced arms of such length and width dimensions as to define a narrow conductor engaging slot therebetween and to be relatively stiff and inflexible in the plane of said first plate, and said second plate having a second pair of arms of length and width dimensions as to be of greater length than said first arms and to define a second slot therebetween of greater width than said first slot, said second arms of said second plate being more flexible in the plane of said second plate than the first arms and having outwardly directed shoulders on the ends thereof so as to engage in respective apertures in said cover member to engage therewith.

3. An electrical connecting device according to claim 2 wherein said narrow conductor engaging slot is no greater in width than said conductor.

4. An electrical connecting device according to claim 2 wherein said slot of said second plate is no narrower in width than said conductor.

5. An electrical connecting device according to claim 2 wherein said slot of said first plate is no greater in width than said conductor and said slot in said second plate is no narrower in width than said conductor.

6. An electrical connecting device according to claim 2 wherein said openings in said cover member each have lugs defining shoulders engaged by the shoulders of said second arms.

* * * * *